United States Patent [19]

Nawrath

[11] Patent Number: 4,549,485

[45] Date of Patent: Oct. 29, 1985

[54] PAPER WEB SEIZING APPARATUS FOR USE WITH PRINTING MACHINERY

[75] Inventor: Nikolaus Nawrath, Igenhausen, Fed. Rep. of Germany

[73] Assignee: M.A.N. Roland-Druckmaschinen Aktiengesellschaft, Augsburg, Fed. Rep. of Germany

[21] Appl. No.: 478,071

[22] Filed: Mar. 23, 1983

[30] Foreign Application Priority Data

Apr. 24, 1982 [DE] Fed. Rep. of Germany ..... 3215473

[51] Int. Cl.[4] ..... B41F 13/02

[52] U.S. Cl. ..... 101/219; 101/228; 101/232; 226/11

[58] Field of Search ..... 101/224, 225, 226, 227, 101/228, 232, DIG. 6, 219; 226/11, 124

[56] References Cited

FOREIGN PATENT DOCUMENTS 541215 11/1941 United Kingdom ..... 101/228
1408176 10/1975 United Kingdom ..... 101/228

OTHER PUBLICATIONS

"Drive Mechanism for Paper Feed Roller"; Microvich et al.; *Xerox Disclosure Journal;* vol. 6, No. 2, p. 53; Mar./Apr. 1981.

*Primary Examiner*—Edgar S. Burr
*Assistant Examiner*—David A. Wiecking
*Attorney, Agent, or Firm*—Frishauf, Holtz, Goodman & Woodward

[57] ABSTRACT

To prevent damage to a printing cylinder, typically the blanket cylinder of rotary offset printing machine, upon tearing of a paper web, which usually occurs within a dryer, a paper web seizing apparatus is positioned downstream of the last printing station. The apparatus includes a roller (15) which is driven at the speed somewhat higher than the linear speed of the paper web by a belt drive (20,21,22) from a friction wheel (18) and held out-of-engagement with the other roller (3) of the pair by a latching mechanism (24, 25, 26—FIG. 2). Upon sensing of a tear, the electromagnetic (26) of the latching mechanism permits a spring (23) to disengage the first roller (15) from the friction drive (18), the roller continuing to rotate due to inertia and engaging the web (A) and then being driven by the positive drive (8,9,10) of the first roller, thus wrapping any torn web about the first roller and preventing damage to the printing cylinders of the printing machine.

13 Claims, 2 Drawing Figures

1
2
3
4
5
6
7
7'
8
9
10
11
12
13
14
15
16
17
18
19
20
21
22
A 3
4
11
12
14
15
18
19
21
23
24
25
26
A

PAPER WEB SEIZING APPARATUS FOR USE WITH PRINTING MACHINERY

The present invention relates to paper seizing apparatus, and more particularly to an apparatus to prevent damage to printing machines if a paper web passing through the printing machine should tear.

BACKGROUND

Various types of apparatus have been proposed to catch, or seize torn portions of a paper web passing through a web handling machine, typically a printing machine. The referenced German Patent DE PS No. 21 56 505 (to which British No. 1,408,176 corresponds) describes an arrangement in which a pair of clamping rollers are provided which are driven continuously in synchronism with rotation of rotary elements of the printing machine. In normal operation, the rollers are spaced from each other, and the web, usually freshly printed and still having wet ink thereon, is passed between the rollers without contact therewith. If the web should tear—signal led, for example, by any well-known and customary tension sensing apparatus—the rollers are moved towards each other to clamp the web therebetween and prevent wrap-around of paper on the printing cylinders of the printing machine, for example around a rubber blanket cylinder thereof. For accurate seizing, the rollers are driven, usually at a circumferential speed which corresponds to about the linear speed of the web passing through the printing machine. When the paper web is to be seized, both rollers continue to be driven. The referenced patent describes a gear train to drive the seizing rollers.

The apparatus permits seizing of webs, however, requires some time to respond. This time may be increasingly long, particularly with high-speed printing machines. It is determined, to some extent, by the inertia of the moving rollers—typically one of the rollers which is pressed against another one which is axially fixed, and, in addition, movement of the drive gearing, or at least part thereof, consequent upon moving of the rollers. To maintain engagement of the respective drive gears for the movable rollers, the drive gears, likewise must be moved.

THE INVENTION

It is an object to provide a web seizing apparatus which responds rapidly upon receiving an operating signal, for example a signal that the web is torn downstream of the apparatus, and, particularly, in which the response period is substantially decreased over prior art structures.

Briefly, at least one of the rollers is so supported that, upon movement thereof towards the other to seize a paper web therebetween, driving engagement is lost, so that only the roller must be moved. Typically, the moving roller is driven at a somewhat higher circumferential speed than the linear speed of the web. Upon disengagement, the roller will continue to rotate or spin due to inertia; the friction is so low that it will hardly lose any speed. Upon engagement with the web which, then, is pressed against the other roller, driving engagement will continue to be effected.

If the web should have torn, it can wrap itself around any one of the seizing rollers without causing damage to printing cylinders in the printing machine.

By suitable selection of the ratio of the speeds of the respective rollers with respect to the linear speed of the web, and considering the response speed of the seizing apparatus, a web of paper can be fully pulled through the printing machine by the web seizing apparatus. Offset rotary printing machines usually transport the printed web to a dryer. It has been found that tears in the paper web occur usually in the dryer connected to a printing machine. The torn end can readily be removed from the dryer, but the leading edge of the tear had the tendency to wrap itself around a blanket cylinder of the last printing station. This may lead to damage of a printing cylinder therein, typically a blanket cylinder. The structure of the present invention has the advantage that a torn web will not damage or interfer with the operation of the printing cylinders and insures, particularly in high-speed printing machines, that the torn end will not damage the printing system. Rather, it will wrap itself about the rollers of the seizing apparatus, for which the printed material can readily be removed without causing any damage to the blanket cylinders or to any other cylinders in the printing machine system. The apparatus is preferably located just downstream of the last printing station of a printing machine, for example of the multistation printing machine, and in advance of a dryer.

DRAWINGS

Figure 1:
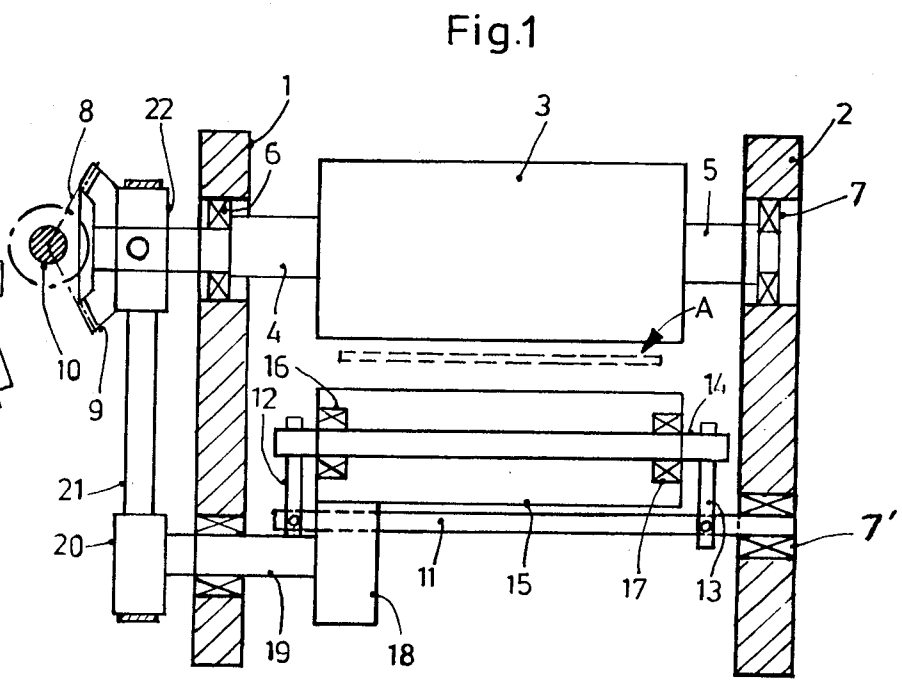
FIG. 1 is a schematic front view of the apparatus.

The apparatus is positioned between sidewalls 1, 2, of a printing machine system, or side walls of the apparatus, shown only schematically. It is located downstream—with respect to travel of the web A—of the last printing station of a series of printing stations of a rotary offset printing machine, for example, and not shown in the drawings. The printing machine, and the printing stations can be of any suitable and well-known construction.

The web seizing apparatus has a roller 3 which is supported by sub shafts 4, 5, in bearings 6, 7, which are located in the sidewalls 1, 2, or frame of the machine. The roller 3 is driven by a right-angle drive 8, 9, from the main drive shaft 10 of the printing machine. Preferably, the gearing transmission from the drive shaft 10 to the shaft 4 of the roller 3 is such that the circumferential speed of the roller 3 is at least as high as that of the web A, or, preferably, slightly higher in order to compensate for delay in response time.

The roller 3, thus, is journaled in the sidewalls 1, 2. A pivotable rod 11 is located parallel to the axis of rotation of the roller 3. Rod 11 may, for example, have a circular diameter, and is pivotably retained in the sidewalls 1, 2 by bearings, of which only a bearing 7' is shown. The other bearing, at the left side of rod 11, has been omitted from the drawing for clarity. The cross rod 11 has levers 12, 13 rigidly secured thereto, or splined thereon. The levers 12, 13 retain a shaft 14 therebetween on which a second roller 15 is journaled by bearings 16, 17. Thus, the second roller 15, together with roller 3 forms a clamping pair when the rollers are moved in engagement with each other.

Figure 2:
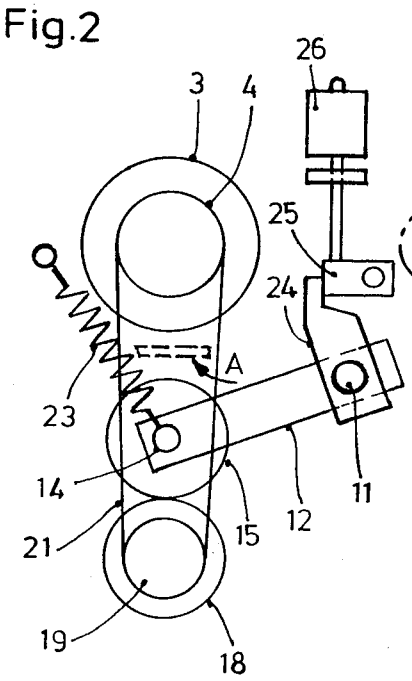
FIG. 2 is a fragmentary side view illustrating the clamping release mechanism.

In normal operation of the printing machine, the web A passes between the rollers 3, 15 without contact therewith—see FIGS. 1 and 2—in which the web A is shown in broken lines.

The roller 15 is positioned by the cross rod 11 as shown in FIGS. 1 and 2. A friction wheel 18 engages the roller 15, and drives the roller 15 at printing machine speed, or preferably slightly thereabove. The speed of operation of the roller 15 may even be above that of roller 3. The friction wheel 18 is secured to a shaft 19 which is journaled in a suitable bearing in the sidewalls 1, 2 of the apparatus. Shaft 19 carries a belt pulley 20, which is driven by a flat belt 21, looped at its upper end about a second pulley 22, which is secured to the stub shaft 4 and rotatable therewith. Thus, roller 15 is driven directly from the same shaft which also drives the roller 3.

As seen in FIGS. 1 and 2, the roller 15 is engaged by the friction wheel 18, and driven thereby. The engagement position of the friction 18 is defined by a locking mechanism 24, 25—see FIG. 2. A locking latch 24, secured to the shaft or rod 11 is engaged by a movable locking latch element 25, and holds the rod 11 in a rotated position such that the roller 15 is engaged by the friction roller 18, counter the pulling force of a spring 23, which is linked to a holding element of the roller 15. The other end of the spring 23 is secured to the frame, for example the sidewall 1, or any other suitable support position or bracket. The cross rod 11, thus, is restrained in the position shown in FIG. 2, against movement. An electromagnetic 26 is provided which can pull in the latch element 25, thereby releasing the lock element 24.

OPERATION

Let it be assumed that the web A tears downstream from the printing machine. A web sensing device—for example any well-known web tension sensor, such as a spring loaded roller or the like will provide a "tear" output signal which is conducted to energize the magnet 26, causing the armature thereof to be pulled upwardly (FIG. 2) and thus release the latch element 24. Spring 23 will snap the roller 15 upwardly, in clockwise direction, so that roller 15 will be pulled against the roller 3, losing engagement contact with the drive roller 18. Loss of engagement will occur immediately, and even before engagement of the roller 15 through the web A with the roller 3.

Under ordinary operation, with the integrity of the web A unimpaired, the roller 15 is driven at a circumferential speed which is somewhat above the linear speed of the web A. Upon loss of contact with the drive wheel 18, the spinning or rotary inertia of the roller 15 will continue to drive the roller 15, although it will decelerate due to friction losses. Yet, the movement is so fast, and the time delay between disengagement of roller 15 from drive roller 18 and engagement—through the web A—with the roller 3 so small that the roller 15 will still have a speed which is at least equal to that of the paper web. As soon as the roller 15 is engaged with the roller 3—through the paper web A—and while the paper web A is still fed from the printing machine, the paper web A will be seized between the rollers and clamped therebetween. As soon as the roller 15 is engaged with the roller 3, with web A interposed, roller 15 will then be driven from the drive power applied to the roller 3 through the gearing 8, 9 and shaft 10.

Preferably, roller 3, 15 will have an outer surface coating or jacket of a friction material, for example rubber, plastic or the like.

The selection of the ratio of speeds of the roller 3, 15, with respect to the speed of the web should be so arranged that the response speed of the seizing apparatus, the inertia of roller 15, and the speed of the web A are properly matched, so that the web A is fully pulled through the then engaged roller pair 3, 5, to prevent pile-up of the web behind the printing cylinders of the printing machine. This, then, effectively prevents that the web will roll itself above the printing cylinders of the printing machine, which might lead to damage thereof. As well known, rotary offset printing machines, particularly, have the tendency to cause tearing of the web. Such tears frequently occur in a dryer connected downstream to web. The torn end is pulled out of the dryer, and the leading edge of the torn web can wrap itself about the blanket cylinder of the last printing station of the printing machine. The structure of the present invention effectively prevents this malfunction, insures that the torn end will not cause damage to the printing station. It may, however, wrap itself about the pair of clamping rollers 3, 15, or, around one of them. Yet, the operability of the printing system is maintained.

Various changes and modifications may be made within the scope of the inventive concept. For example, the roller 15 need not be driven by a friction drive 18, but, rather, a gear can be used which is coupled to a gear placed on the end of the roller 15. Of course, other drives rather than the belt drive 21 may be used, for example a gear drive, a chain belt, or chain drive or the like.

The roller 3, preferably, is fixed in position in fixed bearings 6, 7. Of course, it is equally possible to also place roller 3 in a movable suspension, for example a suspension similar to that of roller 15, and acting with respect to roller 15 in a downwardly directed movement, so that a web A is clamped in scissor fashion between the two movable rollers 3, 18. In such an arrangement, a separate, disengageable drive to roller 3 is then preferably provided, for example a friction wheel 18 engaging the circumference of roller 3, and arranged in mirror-image drive to that shown with respect to roller 15. The belt drive 20, 21, 22 can then be independently driven from shaft 10. Such a construction is substantially more complex than that shown in the embodiment and, thus, may be justified only for special applications. The preferred embodiment, shown in FIGS. 1 and 2 is usually sufficient for most applications.

Various other changes and modifications may be made within the scope of the inventive concept.

I claim:

1. Web seizing apparatus for combination with a printing machine having a printing cylinder, to seize a web (A) which may tear as it passes through the printing machine having a support frame (1, 2);

a pair seizing rollers (3, 15);

bearings (6, 7; 16, 17) supporting said rollers in the support frame, spaced from each other, and located for passage of the web (A) between the rollers without contact therewith;

drive means (8, 9, 10; 18–22) positioned in driving engagement with said rollers to rotate the rollers; and means (7', 11, 12, 13) for supporting the bearings of at least one (15) of the rollers in the frame for relative movement with respect to the other roller (3) for clamping the web (A) between the rollers in case of tearing of the web to thereby prevent winding of the web about a printing cylinder of the printing machine wherein, in accordance with the invention, the bearing support means (7', 11, 12, 13) for said at least one (15) movable roller are positioned to move said at least one roller out of engagement with the drive means (18–22) for said at least one roller and for subsequent driving engagement with the other roller, with the web interposed, and thereby permit free rotation by spinning inertia of said at least one roller during said movement from engaged position with the drive means to engagement with the other roller.

2. Apparatus according to claim 1 wherein said other roller (3) is rotatable in fixed bearings located in said frame (1, 2);

and wherein said one roller (15) is movable in a direction towards said other roller.

3. Apparatus according to claim 2 wherein said rollers have roller shafts (4, 5; 14);

and a cross rod (11) is provided, pivotably supported in said frame (1,2) and movably supporting the roller shaft (14) of said at least one roller.

4. Apparatus according to claim 2 wherein said drive means includes a friction wheel (18) journaled in the frame (1).

5. Apparatus according to claim 1 wherein the printing machine has a main drive shaft (10);

and the drive means includes a positive drive (8, 9) between the drive shaft (10) and the other roller (3).

6. Apparatus according to claim 5 wherein said drive means includes a friction wheel (18) journaled in the frame (1);

and wherein the drive means further includes a drive connection from said positive drive to the friction drive wheel (18).

7. Apparatus according to claim 6 wherein said drive connection includes a belt drive (20, 21, 22).

8. Apparatus according to claim 2 further including a latching mechanism to maintain the pivotable cross rod (11) in a first position at which said at least one roller (15) is spaced from the other roller, and, upon unlatching, permits pivoting of said cross rod (11) towards said other roller and thereby clamp the web (A) between said rollers;

and spring means (23) tending to move said at least one roller from the first to the second position upon unlatching of the latching mechanism.

9. Apparatus according to claim 8 wherein the latching mechanism includes an electromagnetic latch (24, 25, 26).

10. Apparatus according to claim 1 wherein at least one of said rollers (3, 15) has a surface of at least one of the materials of the group comprising: rubber; plastic.

11. Apparatus according to claim 3 wherein the printing machine has a main drive shaft (10);

said drive means includes a friction wheel (18) journaled in the frame (1);

the drive means further includes a positive drive (8, 9) between the drive shaft (10) and the other roller (3);

and wherein the drive means further includes a drive connection from said positive drive to the friction drive wheel (18); and including a latching mechanism to maintain the cross rod (11) in a first position at which said at least one roller (15) is spaced from the other roller, and, upon unlatching, permits pivoting of said cross rod (11) towards said other roller and thereby clamp the web (A) between said rollers;

and spring means (23) tending to move said at least one roller from the first to the second position upon unlatching of the latching mechanism.

12. Apparatus according to claim 1, wherein the drive means (8, 9, 10; 18–22) driving said at least one movable roller (15) drives said roller to have a circumferential linear speed which is at least as great as the linear speed of the web (A).

13. Apparatus according to claim 1, wherein the drive means (8, 9, 10; 18–22) driving said at least one movable roller (15) drives said roller to have a circumferential linear speed which is somewhat above the linear speed of the web (A).

* * * * *